US007775201B2

(12) United States Patent
Cooper

(10) Patent No.: US 7,775,201 B2
(45) Date of Patent: Aug. 17, 2010

(54) ATTACHMENT APPARATUS AND METHOD

(75) Inventor: Darin B. Cooper, Layton, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 445 days.

(21) Appl. No.: 11/247,629

(22) Filed: Oct. 11, 2005

(65) Prior Publication Data

US 2007/0079820 A1 Apr. 12, 2007

(51) Int. Cl.
*F41B 5/00* (2006.01)
*F41B 5/06* (2006.01)

(52) U.S. Cl. ..... 124/86; 124/25.5; 224/916; 403/322.4; 403/334; 403/409.1

(58) Field of Classification Search ..... 124/23.1, 124/25.5, 25.6, 25.7, 86, 87, 88; 224/916; 248/187.1; 403/321, 322.4, 324, 325, 333, 403/334, 381, 409.1
See application file for complete search history.

(56) References Cited

U.S. PATENT DOCUMENTS 2,793,407 A * 5/1957 Johnston ..... 403/182
3,356,325 A * 12/1967 Schnase ..... 248/187.1
4,570,887 A * 2/1986 Banister ..... 248/187.1
4,635,611 A * 1/1987 Priebe ..... 124/25.7
4,684,285 A * 8/1987 Cable ..... 403/331
4,929,973 A * 5/1990 Nakatani ..... 248/177.1
6,371,424 B1 * 4/2002 Shaw ..... 248/222.12
6,779,932 B2 * 8/2004 DeSorbo et al. ..... 396/419

* cited by examiner

*Primary Examiner*—John Ricci
(74) *Attorney, Agent, or Firm*—Holland & Hart

(57) ABSTRACT

An assembly is disclosed, which may include at least one latch element having at least one retaining wall comprising a tapered surface. Further, the assembly may include at least one base element having at least one tapered side surface configured to couple to a respective tapered surface of the at least one retaining wall. Optionally, the latch element may include at least two retaining walls and the base element may include at least two tapered side surfaces. A movable locking element may be configured to be selectively positioned at a first position to couple the at least one base element to the at least one latch element and at least a second position to decouple the at least one base element and the at least one latch element. An archery system including such an assembly is disclosed as well as a method of coupling a base element to a latch element. Adjustable quivers and components are disclosed.

49 Claims, 10 Drawing Sheets

ATTACHMENT APPARATUS AND METHOD

TECHNICAL FIELD OF THE INVENTION

The present invention relates to various embodiments of apparatuses configured to be selectively coupled to or decoupled from one another, assemblies of such apparatuses, and systems including such apparatuses. Further, the present invention relates to archery systems, quivers, and quiver components.

BACKGROUND OF THE INVENTION

Mechanical couplings are useful in many environments and for many different applications. Particularly, mechanical couplings may be employed in the context of sporting equipment such as archery systems, recreational vehicles, watercraft, automobiles, as well as numerous other applications.

Accordingly, it would be advantageous to provide mechanical attachment apparatuses and methods. Also, it would be advantageous to provide improved archery systems, quivers, and quiver components.

SUMMARY OF THE INVENTION

One aspect of the present invention relates to an archery attachment system comprising an archery bow and a latch element affixed to the archery bow. Further, the latch element may include at least two retaining walls, wherein the retaining walls may each include a tapered surface. A base element, complimentary to the latch element, may be affixed to an archery accessory or component. The base element may include at least two tapered side surfaces, wherein the two tapered side surfaces are configured to engage respective tapered surfaces of the two retaining walls of the latch. Also, the base element may be structured to be secured to the latch element. Additionally, a movable locking element may be used to secure the base element to the latch element. More specifically, the locking element may be configured to be selectively positioned at a first position configured for coupling the base element to the latch element and a second position configured for decoupling the base element and the latch element.

More generally, an archery bow may include at least one latch element, at least one base element, or combinations thereof, without limitation. Further, a component may include an associated base element, an associated latch element, or associated combinations thereof, without limitation. For example, in some embodiments, a plurality of latch elements and a plurality of base elements may provide additional stability or strength in coupling of the base elements to the latch elements. In other embodiments, a plurality of latch elements (or base elements) may provide a plurality of locations to which a base element may be coupled.

Another aspect of the present invention relates to an assembly. Particularly, an assembly may include a latch element including at least two retaining walls, wherein each of the retaining walls comprises a tapered surface and a base element including at least two tapered side surfaces, wherein each of the at least two tapered side surfaces is configured to couple to a respective tapered surface of the at least two retaining walls. Further, the base element may be structured to be coupled to the latch element. In addition, a movable locking element may be configured to be selectively positioned at a first position configured for coupling the base element to the latch element and at least a second position configured for decoupling the base element and the latch element.

Generally, an assembly according to the present invention may include at least one latch element and at least one associated base element, without limitation. Thus, the present invention contemplates generally that at least one base element and at least one latch element may be coupled to one another or decoupled from one another.

In another aspect of the present invention relates to a method of coupling a base element to a latch element. Specifically, a latch element may be provided having at least two retaining walls, wherein each of the retaining walls includes a tapered surface. Also, a base element may be provided, the base element including at least two tapered side surfaces, wherein each of the tapered side surfaces is configured to engage the tapered surfaces of the respective retaining walls. Further, the base element may be positioned so that the tapered side surfaces of the base element are adjacent to the retaining walls of the latch element, respectively. Optionally, the tapered side surfaces of the base element may be biased toward the at least two retaining walls of the latch element.

A further aspect of the present invention relates to an assembly. More particularly, an assembly may comprise a latch element including at least one retaining wall including a tapered surface and a base element including at least one tapered side surface configured to couple to the tapered surface of the at least one retaining wall. The base element may be structured to be coupled to the latch element. In addition, the assembly may include a movable locking element configured to be selectively positioned at a first position configured for coupling the base element and the latch element and at least a second position configured for decoupling the base element and the latch element.

Yet an additional aspect of the present invention relates to an archery bow quiver. Particularly, an archery bow quiver may comprise a hood affixed to at least one support rod and a retention member affixed to at least one support rod. Further, the archery bow quiver may comprise an adjustment device configured to position the at least one support rod affixed to the hood with respect to the adjustment device and configured to position the at least one support rod affixed to the retention member with respect to the adjustment device.

Also an archery bow quiver component is disclosed, which may comprise a hood affixed to at least one support rod and an adjustment device configured to position the at least one support rod affixed to the hood with respect to the adjustment device. In another embodiment, the archery bow quiver component may comprise a retention member affixed to at least one support rod and an adjustment device configured to position the at least one support rod affixed to the retention member with respect to the adjustment device.

Features from any of the above-mentioned embodiments may be used in combination with one another in accordance with the present invention. In addition, other features and advantages of the present invention will become apparent to those of ordinary skill in the art through consideration of the ensuing description, the accompanying drawings, and the appended claims.

BRIEF DESCRIPTION OF THE DRAWINGS

Advantages of the present invention will become apparent upon review of the following detailed description and drawings, which illustrate, as mere representations that are not necessarily drawn to scale, various embodiments of the invention, wherein.

DETAILED DESCRIPTION OF THE INVENTION

Various attachment and coupling apparatuses may be desirable for many mechanical systems. For example, archery bows commonly include accessories or components such as quivers, sighting mechanisms, stabilizers, arrow rests, vibration dampening devices, and the like, all of which may need to be repeatedly attached and detached from the archery bow. Such flexibility may be advantageous for providing ease of use and for equipping the archery bow with desired components. More generally, many types of mechanical systems may include components that are desirably repeatedly coupled to and decoupled from such systems. For example, bicycles, motorcycles, skiing equipment, snowshoe equipment, all terrain vehicles, guns, telescopes, boats, and fishing equipment are but a few examples of systems wherein repeated coupling and decoupling of components may be advantageous. Of course, the present invention contemplates that any system including components that may be coupled to or decoupled from such a system may employ an apparatus or method according to the present invention, without limitation.

Generally, the present invention relates to apparatuses structured to mechanically couple to one another. The present invention also contemplates that at least one latch element, at least one base element, or combinations thereof may be affixed to a component of a system. Thus, such components may be selectively coupled to one another by coupling the latch element, the base element, or combinations thereof, to each other. Optionally, a plurality of latch elements and a plurality of base elements may be employed to couple to and decouple from one another, as desired.

More particularly, in one embodiment, the present invention relates to a base element including two tapered wall surfaces and a latch element including two complimentary retaining walls configured for retaining or holding the tapered wall surfaces of the base element. The present invention further relates to a locking element for coupling the base element to the latch element. The locking element may be configured for selectively securing the base element to the latch element. The locking element also includes a tapered surface to bear against corresponding tapered surface of the base element. Still further, the locking element may include a bias member to urge the tapered surface of the lock into increasing engagement with the corresponding tapered surface of the base element. When the locking element is biased into contact and force the at least two tapered walls of the base element against the at least two retaining walls of the latch element. Such an assembly may provide a relatively robust apparatus for selectively coupling the latch element and the base element.

Figure 1:
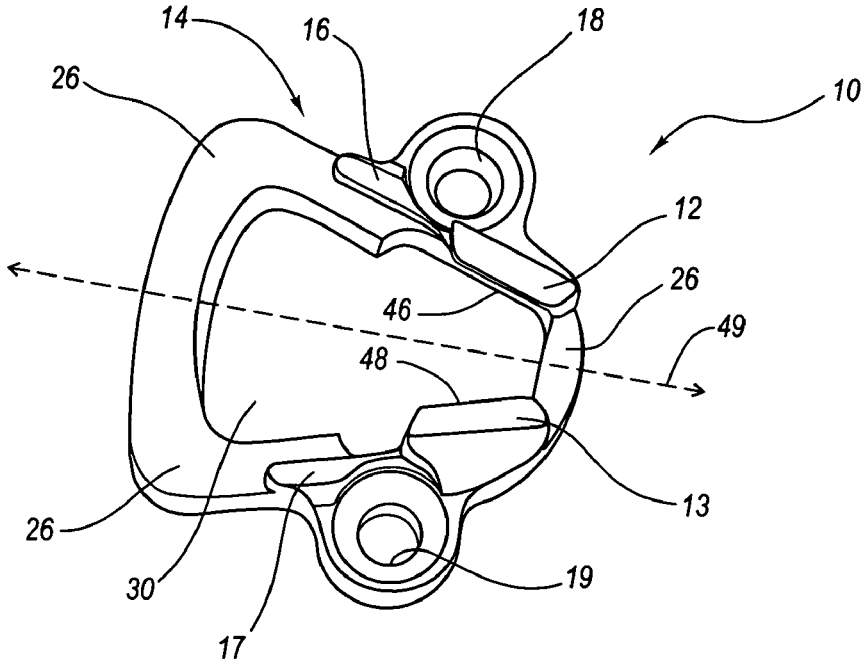
FIG. 1 shows a perspective view of one embodiment of a latch element according to the present invention.

For example, FIG. 1 shows a perspective view of a latch element 10 of the present invention. Latch element 10, as shown in FIG. 1, includes a body 14 having a surface 26. More generally, latch element 10 may include an aperture 30 extending through surface 26 and body 14 or, in another embodiment, may not include aperture 30 (i.e., surface 26 may extend laterally across latch element 10), without limitation. In addition, body 14 may include mounting holes 18 and 19, retaining walls 12 and 13, and retaining supports 16 and 17. Retaining walls 12 and 13 may include tapered surfaces 46 and 48 configured for retaining a base element as discussed in greater detail below. Tapered surfaces 46, 48 may be substantially symmetric about an axis of symmetry 49 and may also be nonparallel. That is, surfaces 46, 48 may be angled relative to axis 49. This allows the base element 50 (FIGS. 3-4) to be wedged into latch element 10 by application of an appropriate force.

Figure 2:
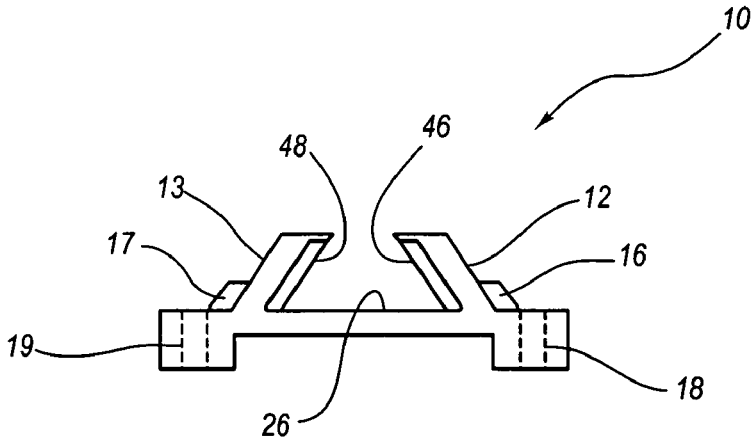
FIG. 2 shows an end view of the latch element shown in FIG. 1.

Surface 26 may be substantially planar. Further, retaining supports 16 and 17 may be structured for facilitating positioning of a base element proximate to retaining walls 12 and 13. Also, mounting holes 18 and 19 may be configured to accept a fastener (e.g., a screw, a bolt, etc.) so that latch element 10 may be affixed to an archery system, as is described in greater detail below. FIG. 2 shows an end view of latch element 10 as if looking toward retaining walls 12 and 13. Such a configuration may form a suitable structure for receiving at least a portion of a base element according to the present invention, as is described in greater detail below.

Figure 3:
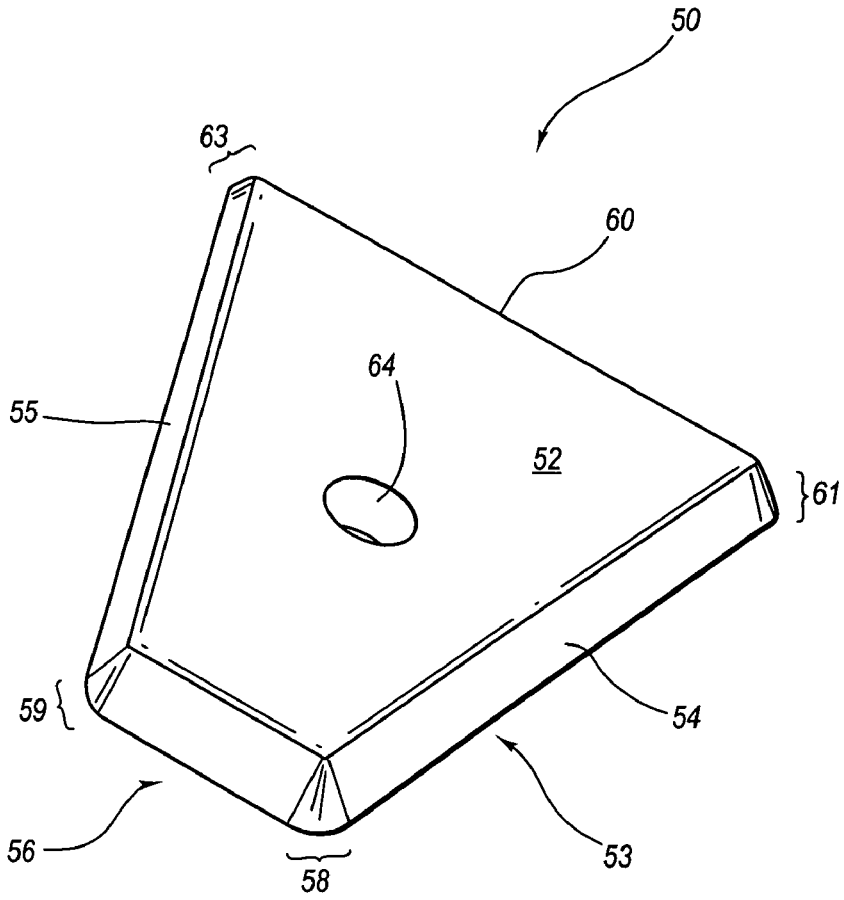
FIG. 3 shows a perspective view of a base element according to the present invention.
Figure 4:
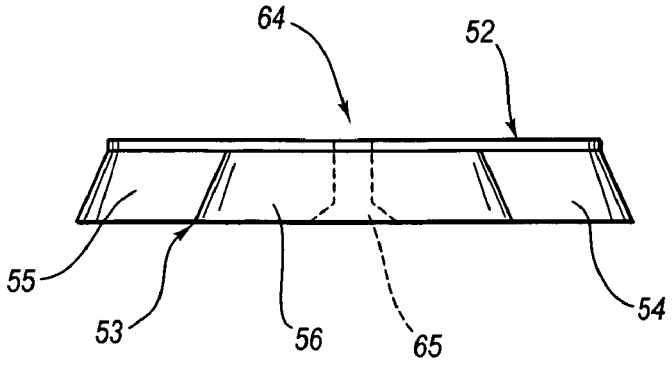
FIG. 4 shows an end view of the base element shown in FIG. 3.

FIGS. 3 and 4 show a perspective view and an endview (i.e., viewed toward nose region 56), respectively, of a base element 50 according to the present invention. Base element 50 includes an upper surface 52 and a lower surface 53, which may both be generally planar and form part of a quadrilateral outer periphery defined by side surface 54, side surface 55, nose surface 56, and end surface 60. Each of side surfaces 54 and 55, nose surface 56, and end surface 60 may taper from upper surface 52 to lower surface 53. More generally, a base element according to the present invention may include at least two tapered (i.e., nonperpendicular with respect to lower surface 53) side surfaces forming at least a portion of the periphery of the base element. Accordingly, it may be appreciated that a base element may be substantially quadrilateral or substantially triangular, without limitation. FIGS. 3 and 4 show rounded comer regions 58, 59, 61, and 63 extending between respective adjacent side surface 54, side surface 55, nose surface 56, and end surface 60. Base element 50 includes a mounting hole 64 extending through upper surface 52 and lower surface 53. More generally, a base element 50 may include at least one mounting hole, without limitation.

Figure 5:
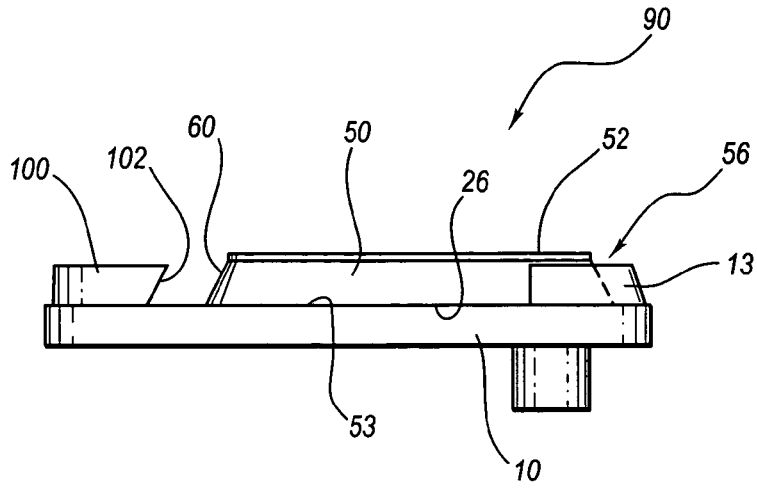
FIG. 5 shows a schematic side cross-sectional view of an assembly including a base element, a latch element, and a locking element positioned to allow the base element to be decoupled from the base element.
Figure 6:
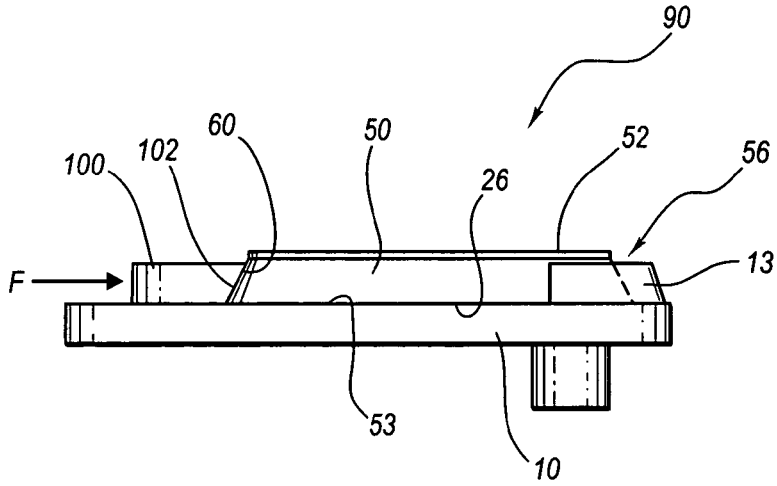
FIG. 6 shows a schematic side cross-sectional view of the assembly shown in FIG. 5 wherein the locking element is positioned to couple the base element to the latch element.

FIGS. 5 and 6 show schematic side cross-sectional views of an assembly 90 of the present invention, including a latch element 10 and a base element 50 in an "open" and closed state, respectively. Particularly, as shown in FIGS. 5 and 6, base element 50 may be positioned so that the nose portion 56 thereof is substantially captured or retained by retaining walls 12 and 13 of latch element 10. Each tapered surface 46, 48 of the retaining walls 12 and 13, respectively, may be substantially congruent (i.e., complementary) with respect to the tapered side surfaces 54 and 55 of the base element 50. Optionally, latch element 10 may include retaining guides 16 and 17 (FIG. 1) configured for positioning base element 50 generally within retaining walls 12 and 13. In addition, lower surface 53 of base element 50 may at least partially engage against surface 26 of latch element 10. As shown in FIGS. 5 and 6, lower surface 53 of base element 50 and surface 26 of latch element 10 may be substantially planar. Such a configuration may be suitable for effectively coupling base element 50 to latch element 10.

Assembly 90, as shown in FIGS. 5 and 6, may also include a movable locking element 100 structured for coupling base element 50 to latch element 10 and for allowing decoupling of base element 50 from latch element 10. Particularly, locking element 100 may be postionable at a position that allows base element 50 to be removed (i.e., decoupled) from latch element 10. Further, the locking element 100 may be positioned at another position (e.g., adjacent end surface 60 of base element 50) to lock, retain, or couple the base element 50 to latch element 10. As shown in FIG. 5, locking element 100 may include a tapered surface 102 that substantially corresponds (i.e., is substantially parallel) to end surface 60 of base element 50. In the second position of the locking element 100, the tapered surface 102 of the locking element 100 may be positioned adjacent to end surface 60 of the base element 50. Such a configuration may couple base element 50 to latch element 10. That is, when the locking element 100 is positioned at the second position, a cavity or recess may be formed by the retaining wall 12, retaining wall 13 of the latch element and the locking element 100 may position the base element 50 within the cavity or recess. Optionally, locking element 100 may contact base element 50. Further, such contact may apply a bias or force (labeled "F" in FIG. 6) to base element 50 in a direction generally toward retaining walls 12 and 13. Such a force F may effectively wedge base element 50 against retaining wall 12, retaining wall 13, and locking element 100. The bias or force will serve to tighten the securement between base element 50 and latch element 10 in an increasing manner. In other words, the tapered side surfaces 54 and 55 of the base element 50 may be biased against the tapered surfaces 46 and 48 of retaining walls 12 and 13, respectively, by force F applied to the base element 50 via locking element 100 resulting in an increasingly tighter connection over time, and particularly if the assembly is bumped or moved over time. Such a configuration may produce an assembly 90 wherein base element 50 and latch element 10 are coupled to one another in a relatively robust and stable fashion.

Figure 7:
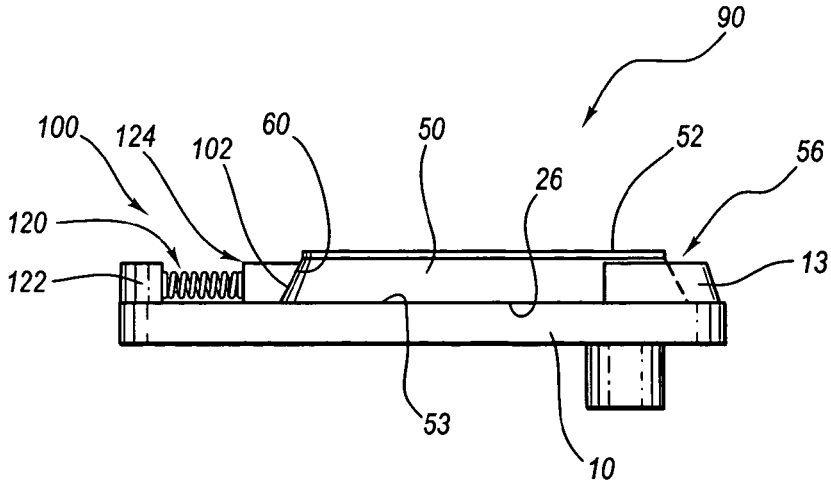
FIG. 7 shows a schematic side cross-sectional view of the assembly shown in FIG. 5 including a biased locking element.

In addition, as may be appreciated, locking element 100 may exhibit various embodiments. For example, in one embodiment, locking element 100 may be selectively secured to latch element 10 by way of threaded fasteners, locking pins, or as other reversible affixation as known in the art. In another embodiment, locking element 100 may comprise a portion thereof that is anchored or secured to latch element 10 and a portion that is movable, wherein the movable portion is configured to be positionable adjacent to or abutting against base element 50. For example, as shown in FIG. 7, a biasing element 120 may be positioned between an anchor portion 122 and a movable portion 124 of locking element 100 to bias movable portion 120 toward base element 50. Optionally, movable portion 124 may contact base element 50 and may apply a force upon base element 50. Of course, movable portion 124 may be positioned toward anchor element 122 to allow release or decoupling of base element 50 from latch element 10.

It will be apparent to those skilled in the art, based on the above discussion, that the present invention contemplates that a base and a latch element may be coupled to one another along a single tapered surface (i.e., at least one retaining wall including a tapered surface and at least one tapered side surface). For instance, as shown in FIGS. 5-7, an assembly 90 may comprise a latch element 10 including at least one retaining wall 13 including a tapered surface and a base element 50 including at least one tapered side surface configured to couple to the tapered surface of the at least one retaining wall 13. Further, the base element 50 may be structured to be coupled to the latch element 10 and a movable locking element 100 may be configured to be selectively positioned at a first position configured for coupling the base element 50 to the latch element 10 and at least a second position configured for decoupling the base element 50 from the latch element 10. In such a configuration, the engagement surface of retaining wall 12 may be inclined or substantially vertical. In another embodiment, the at least one retaining wall 13 including the tapered surface may be positioned opposite of the movable locking element 100 (i.e., retaining wall 12 may be omitted). As shown in FIGS. 5-7, the hidden line shown within retaining wall 13 may comprise the tapered surface of the at least one retaining wall 13. Such an arrangement may be advantageous in some applications.

The present invention further contemplates that a locking element may be carried by a base element in some embodiments of the present invention. For instance, a locking element may be carried by a base element and may be structured for positioning the base element with respect to the latch element once the base element is positioned generally within the at least two retaining walls of the latch element. Of course, optionally, such a locking element may be biased to generate a force upon the base element for forcing the base element against the at least two retaining walls of the latch element.

Further, many other embodiments of a movable locking element 100 are contemplated by the present invention. For example, in another embodiment, the present invention contemplates that a locking element may be structured and configured to rotate, wherein such rotation positions (at a first position) at least a portion of the locking element adjacent to or abutting against a base element positioned within a latch element. Of course, the locking element may be configured so that rotation of the locking element to another position (i.e., a second position) allows sufficient dimensional clearance for the base element to be positioned within the latch element.

Figure 8:
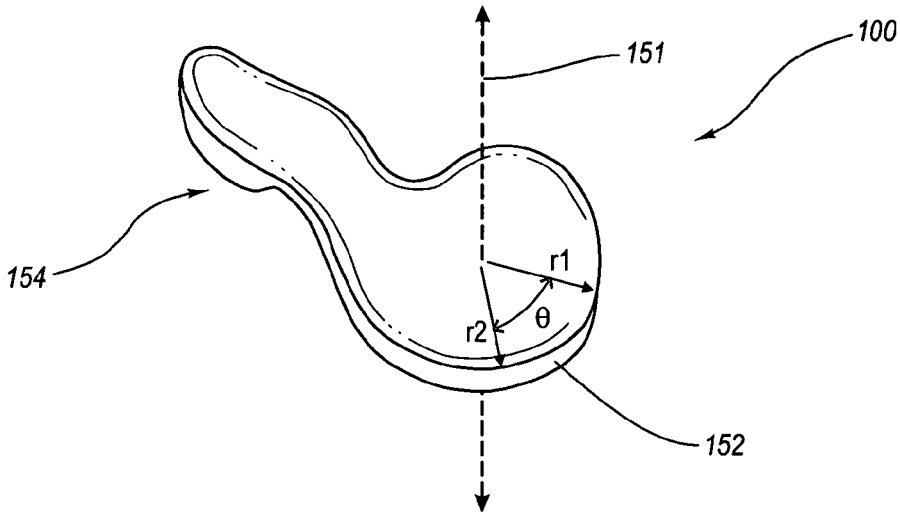
FIG. 8 shows a perspective view of an embodiment of a rotating locking element according to the present invention.

For example, FIG. 8 shows one embodiment of locking element 100, wherein locking element 100 including a tapered surface 152. Tapered surface 152 exhibits a radius that varies with respect to a circumferential or angular position about longitudinal axis 151. Particularly, as shown in FIG. 8, radius R1 may have a magnitude that is different from (e.g., greater than or less than) a magnitude of radius R2, wherein radius R1 and radius R2 are separated by angle θ. Thus, locking element 100, as shown in FIGS. 5-7, may comprise a rotating element having a tapered surface 152 (shown as surface 102 in FIGS. 5-7) that may be positioned adjacent to or in contact with an end surface (e.g., end surface 60) of a base element (e.g., base element 50) by rotating locking element 100 about longitudinal axis 151. Rotation of surface 152 therefore results in an increasingly tight connection because of the differences in radii r2 and r1. In addition, such a rotating locking element 100 may be biased to position a tapered surface 152 proximate or in contact with an end surface (e.g., end surface 60) of a base element (e.g., base element 50). Of course, such a biasing element (e.g., a so-called torsion spring) may be configured to apply a torque to the rotating locking element 100. Further, as may be appreciated, rotation of locking element 100 against an applied torque of a biasing element may be accomplished by manually applying a force to handle region 154 of locking element 100.

Figure 9:
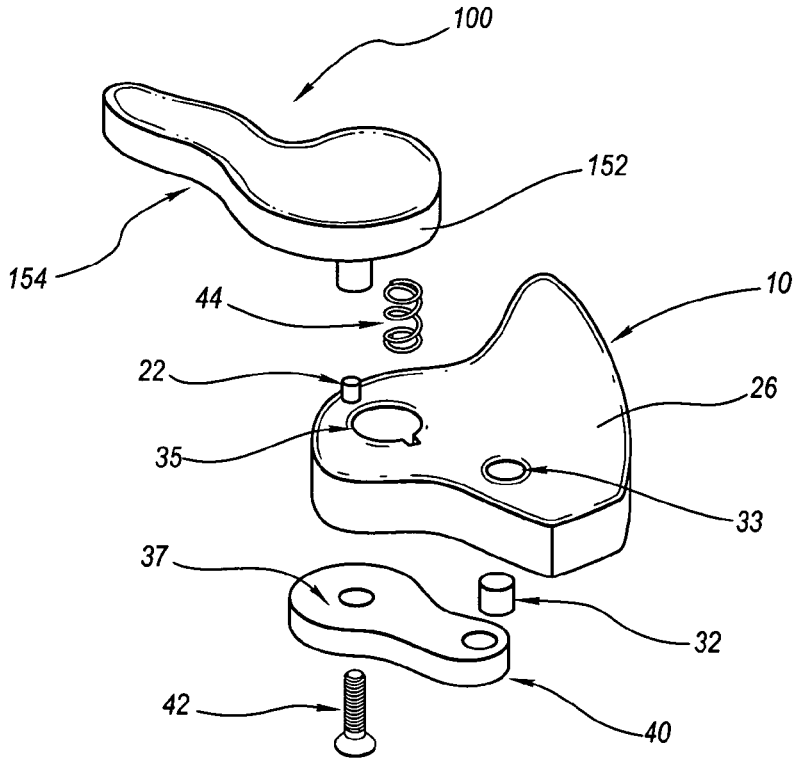
FIG. 9 shows a partial exploded perspective assembly view of a latch element including a rotating locking element according to the present invention.

FIG. 9 shows a partial, exploded assembly view of one embodiment of latch element 10 including a locking element 100 that rotates to couple or decouple a base element to or from the latch element 10. In further detail, latch element 10 may include through holes 33 and 35 that are configured to accept release pin 32 and biasing element 44, respectively. Furthermore, cover plate 40 may be positioned against a lower surface of latch element 10 to capture release pin 32 and biasing element 44 within through holes 33 and 35, respectively. Biasing element 44 may be affixed to at least a portion of through hole 35 and locking element 100 so that torque is applied to locking element 100. Fastening element 42 (e.g., a threaded bolt or machine screw) may extend through through hole 37 and through hole 35 and may threadedly couple to hub 45 of locking element 100. In addition, latch element 10 may include a limit feature 22 which is biased and configured to inhibit additional rotation of locking element 100 beyond a selected rotational position.

Figure 10:
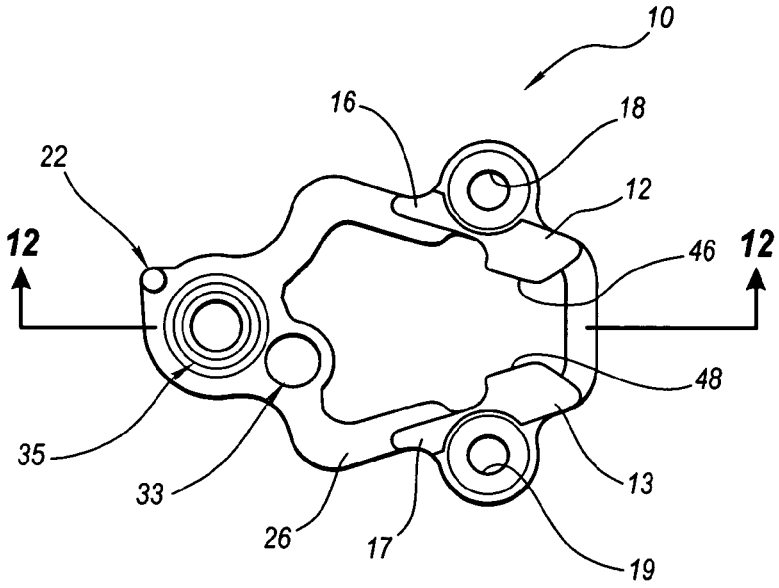
FIG. 10 shows a top elevation view of a latch element according to the present invention.
Figure 11:
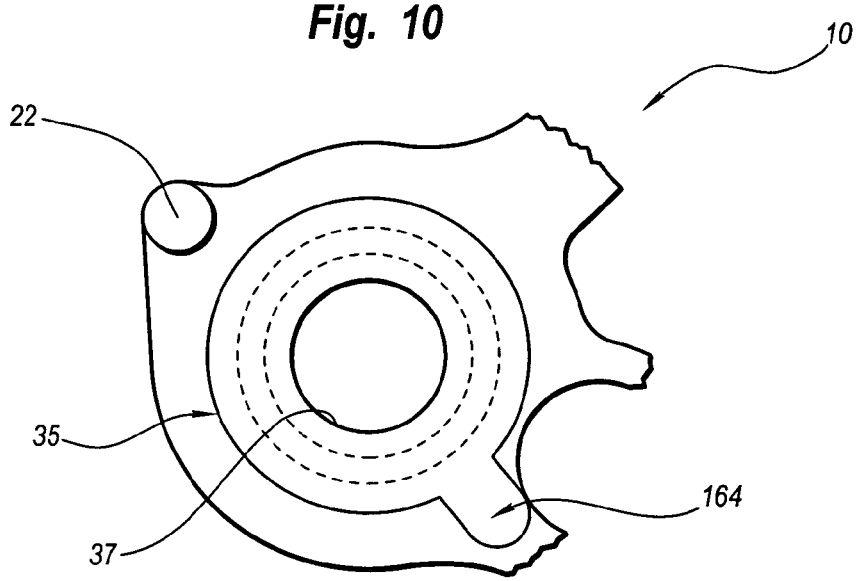
FIG. 11 shows an enlarged partial top elevation view of the latch element shown in FIG. 10.
Figure 12:
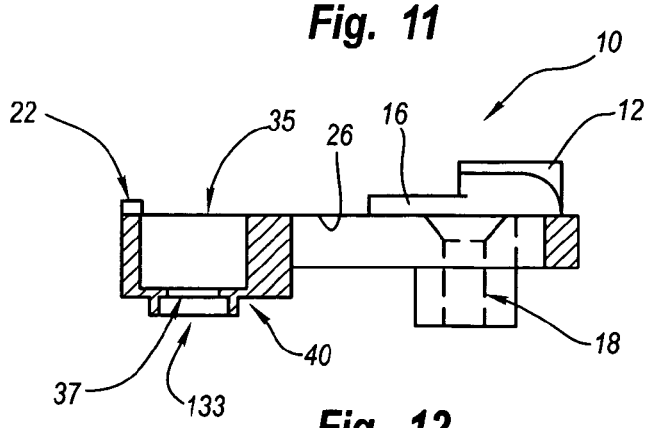
FIG. 12 shows a side cross-sectional view of the latch element shown in FIG. 10.

FIG. 10 shows a top elevation view of one embodiment of a latch element 10 which is configured for assembly with a rotating locking element 100 as shown in FIGS. 8 and 9. In particular, latch element 10 includes through holes 33 and 35, as described above with respect to FIG. 9. FIG. 11 shows an enlarged partial top elevation view of through hole 35 including groove 164. Groove 164 may be sized and configured for preventing rotation of at least a portion of biasing element (e.g., a free end of biasing element 44, as shown in FIG. 9) positioned therein. Such a configuration may provide a mechanism for applying a torque to a locking element. FIG. 12 shows a side cross sectional view of latch element 10 depicting through hole 35, mounting hole 18, surface 26, retaining wall 12, limit feature 22, and retaining support 16. In addition, as shown in FIG. 12, latch element 10 may include a cover plate 40 including a recess 133 for accepting an end (e.g., an enlarged head) of a fastening element and a through hole 37.

Figure 13:
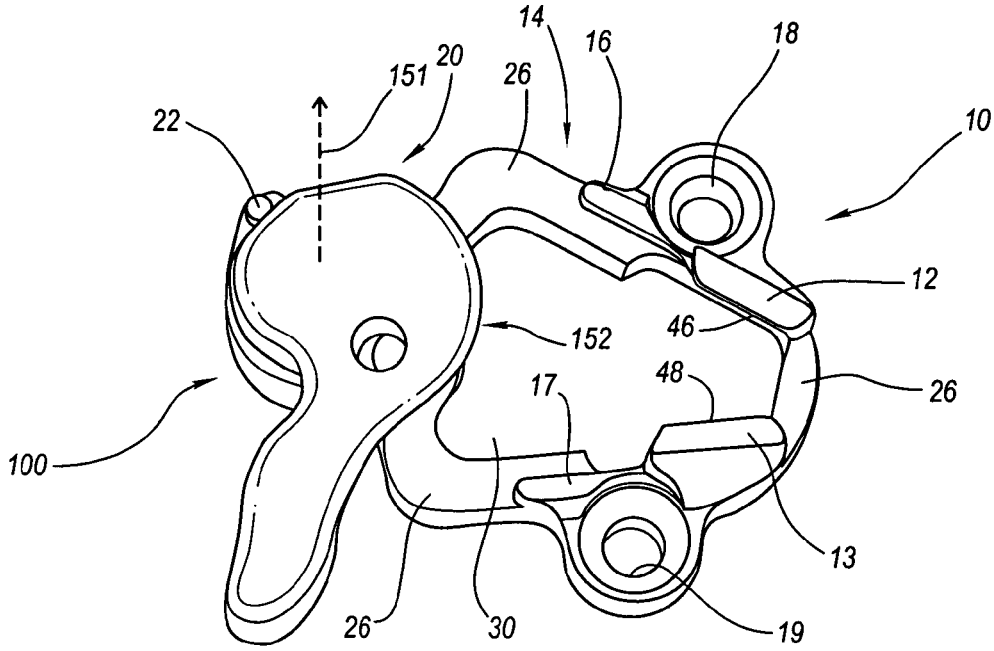
FIG. 13 shows a perspective view of a latch element including a rotating locking element according to the present invention, wherein the rotating locking element is positioned in a locked position.
Figure 14:
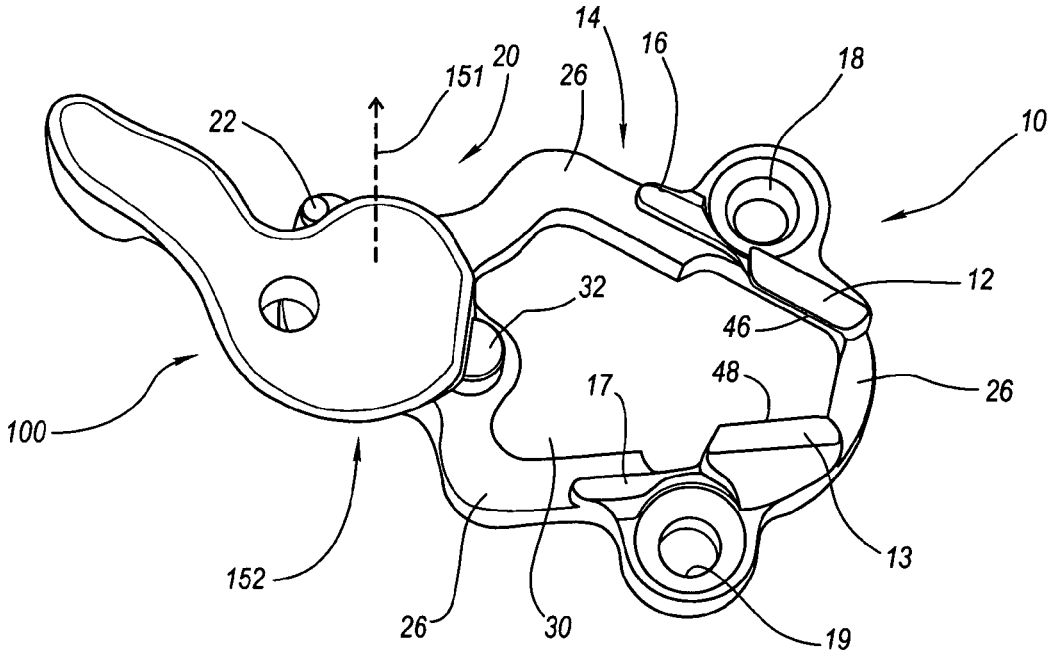
FIG. 14 shows a perspective view of the latch element shown in FIG. 13, wherein the rotating locking element is positioned in an open position.

During operation, locking element 100 may occupy a position wherein release pin 32 effectively locks locking element 100 at the position (e.g., an "open" position or "second" position). For example, FIG. 14 shows latch element 10 including a locking element 100 positioned in an "open" position. Such a position of locking element 100 may allow for a base element 50 to be positioned generally within the retaining walls of the latch element 10 or removal therefrom. Also, release pin 32 may be configured so that positioning of a base element 50 into a latch element 10 causes release element 32 to release locking element 100 so that biasing element 44 may cause rotation of locking element 100 to another position (e.g., a "closed" or "first" position). For example, contact of the lower surface 53 of base element 50 may depress release element 32 to allow locking element 100 to rotate. Such rotation of locking element 100 may cause tapered surface 152 of locking element 100 to be positioned adjacent to or in contact with base element 50. For example, FIG. 13 shows latch element 10 including locking element 100 positioned in a "closed" position. Thus, such a configuration may provide for retention or coupling of base element 50 to latch element 10. Of course, if the base element 50 is to be decoupled from the latch element 10, locking element 100 may be rotated from the closed position to the open position (as shown in FIG. 14), which may allow for pin element 32 to move upwardly (e.g., by biasing) and extend from surface 26 of latch element 10 to move lower surface 53 of base element 50 away from surface 26 of latch element 10 to partially disengage base element 50 from latch element 10. Such partial disengagement may facilitate removal of base element 50 from latch element 10.

The present invention contemplates that at least one latch element and at least one base element may be mounted to a component that is intended to be selectively coupled to another component or to a system. For example, sporting goods, automotive accessories, boating accessories or industrial applications, without limitation, may utilize at least one latch element and at least one base element according to the present invention. Such a configuration may provide a simple and relatively robust coupling mechanism for coupling two components of a system. In addition, such a coupling mechanism may be self-actuated in response to positioning of a base element adjacent to a latch element, as described hereinabove.

Figure 15:
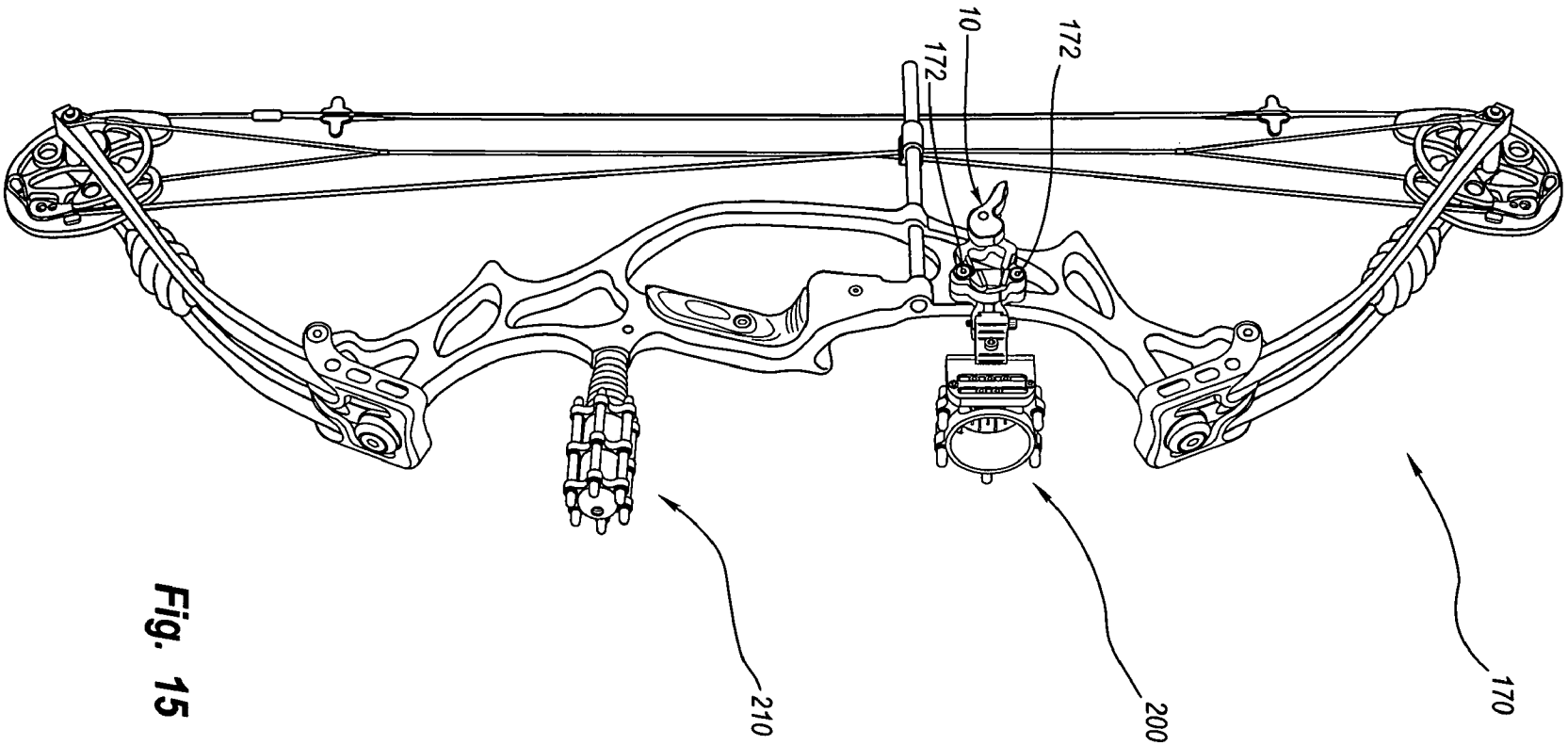
FIG. 15 shows a perspective view of an archery system including a latch element as shown in FIGS. 13 and 14.

In one aspect of the present invention, archery accessories may be selectively coupled to and decoupled from an archery bow by employing at least one latch element and at least one base element according to the present invention. For example, FIG. 15 shows a perspective view of an archery system 170 including a latch element according to the present invention. As shown in FIG. 15, latch element 10 may be affixed to the archery bow system 170 by fastening elements 172 (e.g., machine screws, bolts, or other threaded fastening elements as known in the art). In another embodiment, latch element 10 may be adhesively or otherwise mechanically attached to archery bow system 170. The present invention contemplates that a latch element may be affixed to any archery bow as known in the art, such as, for instance, compound archery bows, recurve archery bows, long bows, or cross bows, without limitation. It may be appreciated that the latch element 10 may, optionally, be formed integrally with (i.e., as a single piece) sight mechanism 200, if desired, or mounted on top of a bracket for a sight mechanism 200, as shown in FIG. 15. Thus, coupling of the latch element 10 to the archery bow system 170 may also couple the sight mechanism 200 to the archery bow system 170. In another embodiment, sight mechanism 200 and latch element 10 may be mounted separately. Optionally, sight mechanism 200 and latch element 10 may be affixed to archery bow system 170 by common fastening elements (e.g., bolts or screws) that couple to common mounting holes formed in the riser of archery bow system 170.

Figure 16:
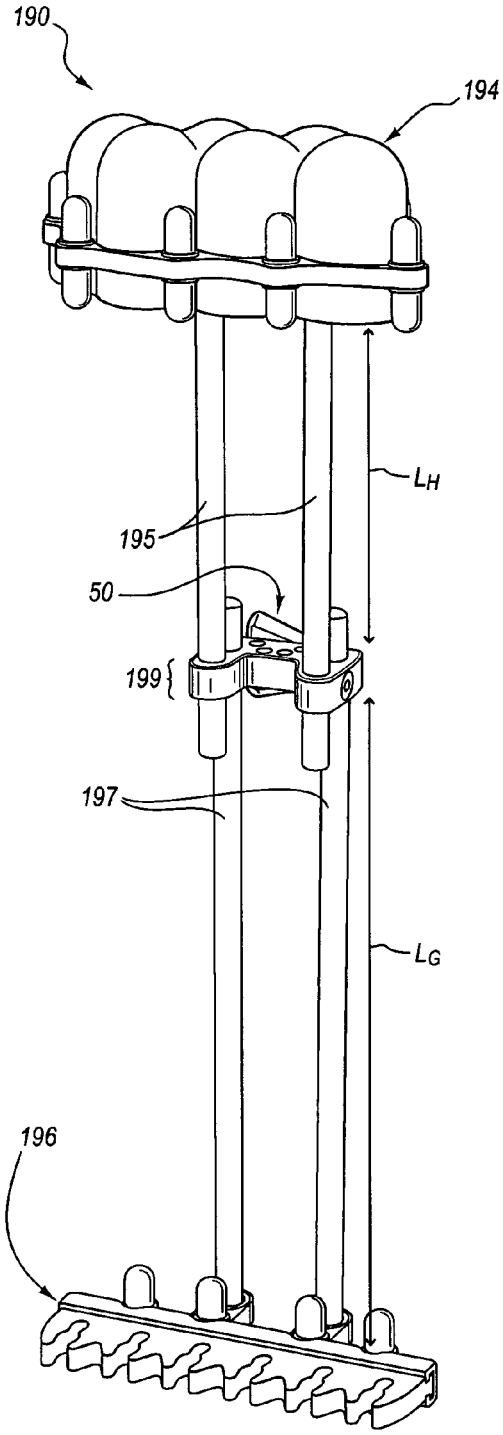
FIGS. 16 and 17 show perspective views of a quiver including a base element at different adjustment positions according to the present invention.
Figure 17:
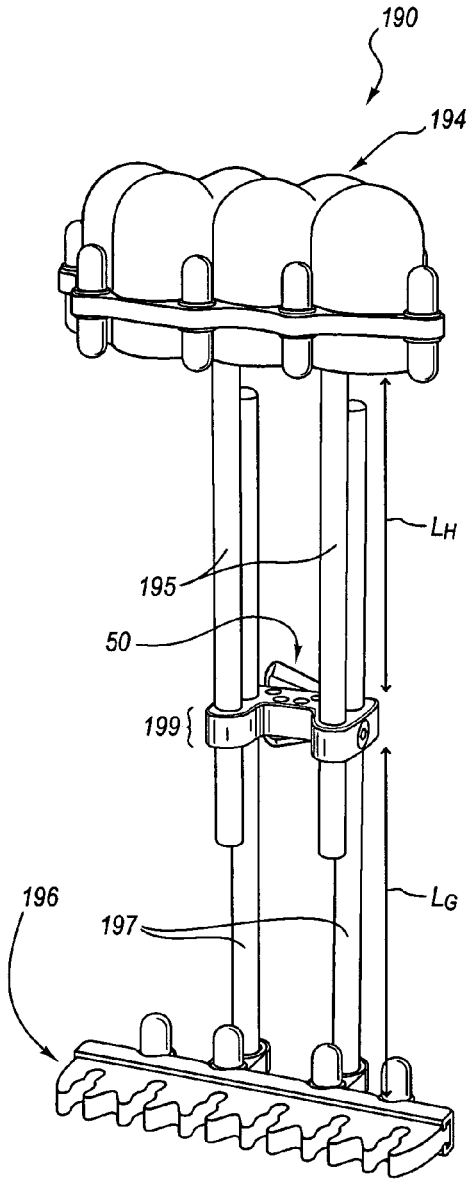

Further, FIGS. 16 and 17 show a quiver 190 to which a base element 50 may be coupled. More particularly, FIGS. 16 and 17 show enlarged perspective views of an archery quiver 90 including a hood 194 and an arrow retention member 196. Hood 194 may be at least partially filled with a foam or other material and may be configured for accepting arrow points, both broadheads and field points, of a plurality of arrows while retention member 196 may be flexible and sized and configured for accepting and holding a portion of each respective arrow shaft of a plurality of arrows being held by the quiver. According to one aspect of the present invention, hood 194 and retention member 196 may be individually positionable with respect to adjustment device 199. Also, hood 194 may be affixed to adjustable support rods 195, and retention member 196 may be affixed to support rods 197, wherein support rods 195 may be coupled to support rods 197 via adjustment device 199. As shown in FIGS. 16 and 17, adjustment device 199 may include holes or spaces through which each of support rods 197 and 195 pass through. Further, as discussed in greater detail below, support rods 197 and 195 may be coupled to such spaces or holes, or otherwise locked or coupled to adjustment device 199. Thus, adjustment device 199 may be employed for selectively positioning support rods 195 and for selectively and separately positioning support rods 197. Thus, hood 194 may be selectively positioned relative to adjustment device 199, as illustrated by the separation distance $L_H$ between hood 194 and adjustment device 199, as shown in FIGS. 16 and 17. Further, retention member 196 may be selectively positioned relative to adjustment device 199, as illustrated by the separation distance $L_G$ between retention member 196 and adjustment device 199, as shown in FIGS. 16 and 17 Securing support rods 195 and support rods 197 relative to adjustment device 199 may be accomplished by a clamping or coupling mechanism (e.g., a set screw, clamp, or other coupling mechanism as known in the art) configured to lock or clamp the adjustment device 199 to support rods 195 and support rods 197 at any selected position along support rods 195 and support rods 197. Accordingly, it may be appreciated that a desired separation distance (e.g., substantially the sum of $L_H$ and $L_G$) between hood 194 and retention member 196 may be achieved by selectively adjusting the position of hood 194, retention member 196, or both relative to adjustment device 199. Thus, archery quiver 90 may be adjustable and may be configured to accept a relatively wide range of arrow lengths and types of arrows. It should be further appreciated that although support rods 195 are shown in FIGS. 16 and 17, one or more support rods may extend between hood 194 and adjustment device 199, without limitation. Similarly, although support rods 197 are shown in FIGS. 16 and 17, one or more support rods may extend between retention member 196 and adjustment device 199, without limitation. In addition, optionally, base element 50 may be coupled to adjustment device 199 by fastening elements positioned within mounting holes formed through the base element 50 as discussed above. In another embodiment, base element 50 may be affixed to coupling device 199 by adhesive or as otherwise known in the art. In a further embodiment, adjustment device 199 may be structured for coupling directly to (e.g., to a riser) an archery bow system, if desired.

Figure 18:
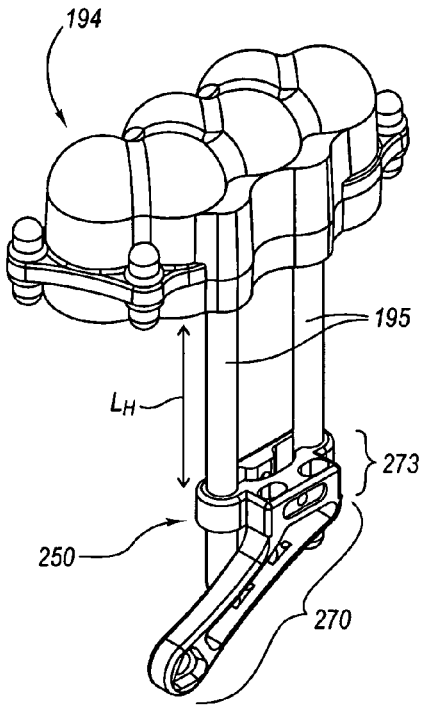
FIGS. 18 and 19 show an adjustable hood portion of a quiver apparatus according to the present invention.
Figure 19:
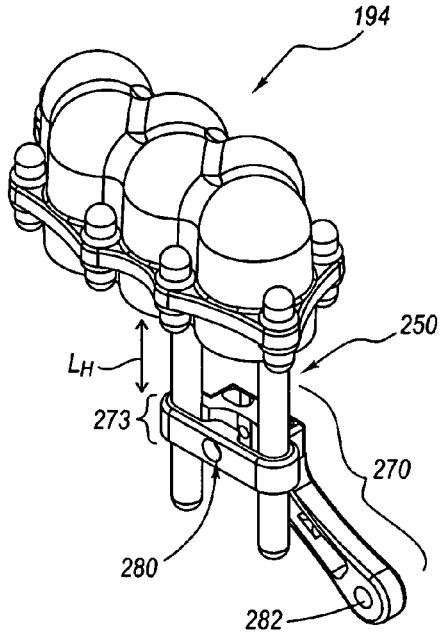
Figure 20:
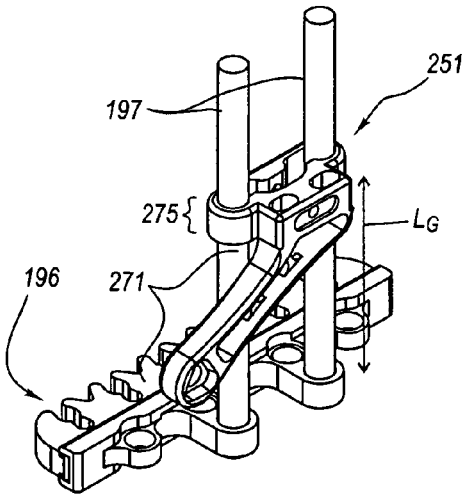
FIGS. 20 and 21 show perspective views of an adjustable arrow retention member according to the present invention.
Figure 21:
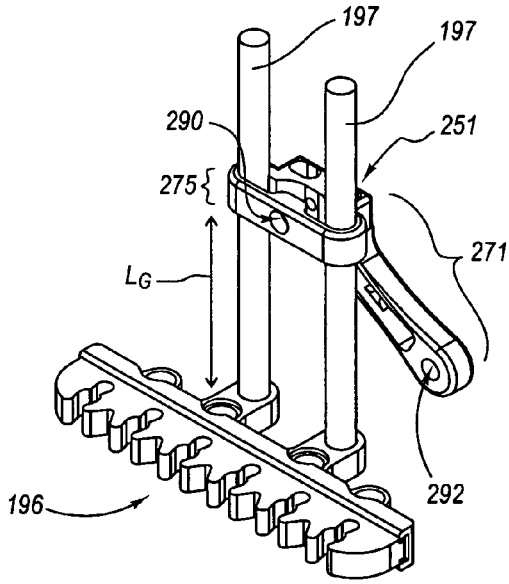

In another embodiment, a hood and a retention member (i.e., an archery quiver component) may be coupled to an archery bow system (e.g., a riser of an archery bow) separately and at different positions. Further, at least one of the hood and the retention member (or both) may be adjustably positionable in relation to an associated adjustment device, respectively, affixed to an archery bow. For example, as shown in FIGS. 18 and 19, hood 194 may be affixed to adjustable support rods 195 and adjustable support rods 195 may be coupled to adjustment device 250. Adjustment device 250 may generally comprise a base portion 273 and a mounting strut 270. As shown in FIGS. 18 and 19, adjustment device 250 may include holes or spaces defined by base portion 273 through which each of support rods 195 pass through. Further, support rods 195 may be coupled to such spaces or holes, or otherwise selectively locked or coupled to adjustment device 250. For example, a clamping or coupling mechanism (e.g., a set screw, clamp, or other coupling mechanism as known in the art) may be configured to lock or clamp the adjustment device 250 to support rods 195 at any selected position along support rods 195. Thus, adjustment device 250 may be employed for selectively positioning support rods 195. Thus, hood 194 may be selectively and variably positioned relative to adjustment device 250, as illustrated by the separation distance LH between hood 194 and adjustment device 250, as shown in FIGS. 18 and 19. Similarly, as shown in FIGS. 20 and 21, retention member 196 may be affixed to adjustable support rods 197 and adjustable support rods 197 may be coupled to adjustment device 251. Adjustment device 251 may generally comprise a base portion 275 and a mounting strut 271. As shown in FIGS. 20 and 21, adjustment device 251 may include holes or spaces defined through base portion 275 through which each of support rods 197 pass through. Further, support rods 197 may be coupled to such spaces or holes, or otherwise selectively locked or coupled to adjustment device 251. For example, a clamping or coupling mechanism (e.g., a set screw, clamp, or other coupling mechanism as known in the art) may be configured to lock or clamp the adjustment device 251 to support rods 197 at any selected position along support rods 197. Thus, adjustment device 251 may be employed for selectively positioning support rods 197. Thus, retention member 196 may be selectively and variably positioned relative to adjustment device 250, as illustrated by the separation distance $L_G$ between retention member 196 and adjustment device 251, as shown in FIGS. 20 and 21. As known in the art, adjustment devices 250 and 251 may be affixed to an archery bow (e.g., to a riser of an archery bow) by affixing at least a portion of adjustment devices 250 and 251 (e.g., via mounting holes 280, 282, 290, 292 of mounting struts 270, 271 and base portions 273 and 275, respectively) to an archery bow. As may be appreciated, adjustment devices 250 and 251 may be, optionally, substantially identical. More specifically, an adjustment device 250 may be mounted to a selected, upper location of an archery bow (e.g., a riser of an archery bow) by any connection structure or method known to those of skill in the art, without limitation. Similarly, an adjustment device 251 may be coupled or mounted to a selected, lower location of an archery bow (e.g., a riser of an archery bow) by any connection structure or method known to those of skill in the art, without limitation. The adjustment devices 250, 251 are separately and independently adjustable relative to each other to vary the distance between the hood 194 and the arrow retention member 196. As mentioned above, one or both adjustment devices 250, 251 may be coupled or mounted to an archery bow, without limitation. Further, optionally, one or more base and latch element, as described above, may be employed for such coupling or mounting, if desired.

Figure 22:
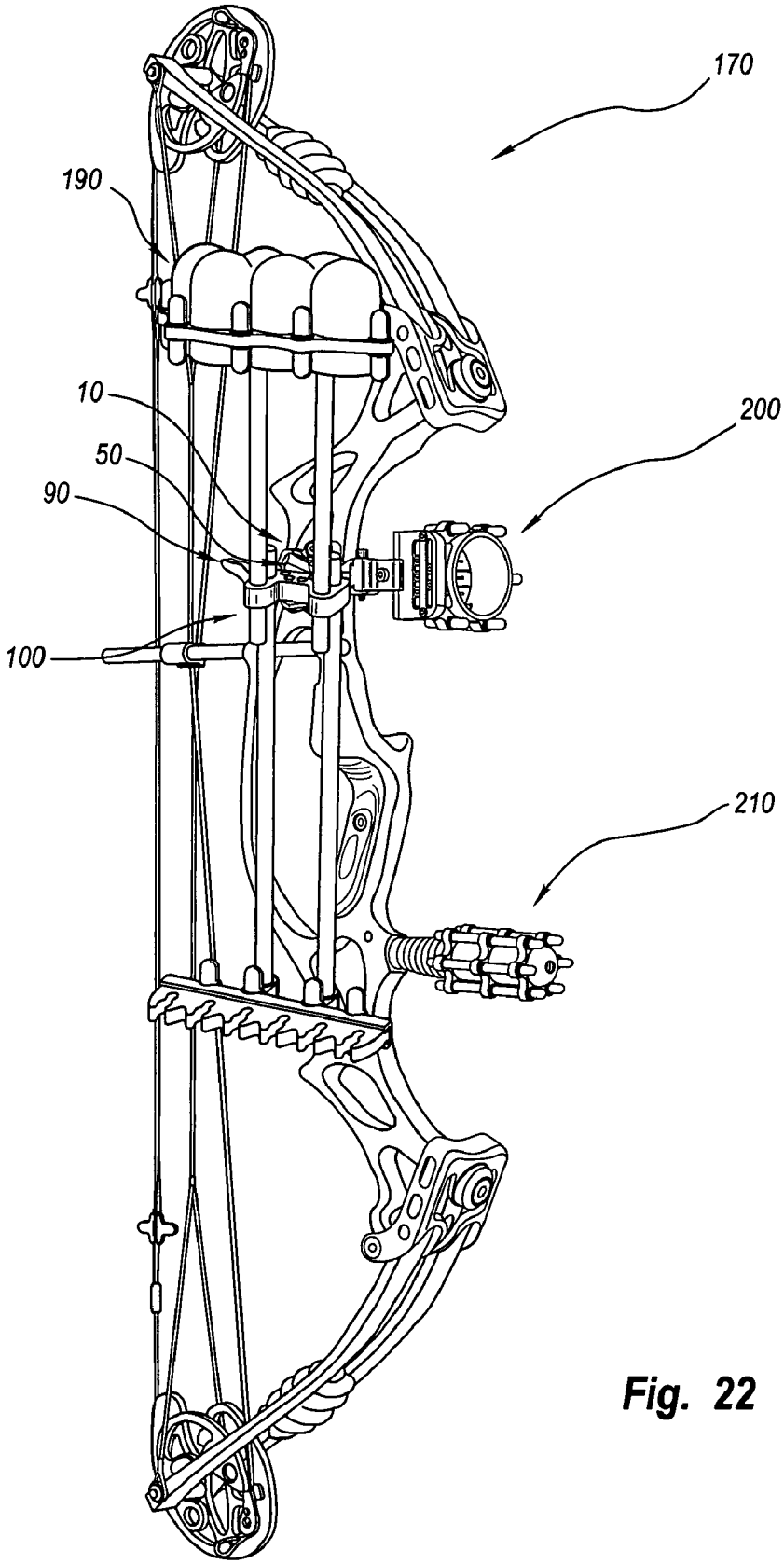
FIG. 22 shows an assembly of the quiver as shown in FIG. 16 coupled to the archery system as shown in FIG. 15.

Of course, any of the above-described quiver embodiments may be coupled to an archery bow. For example, as shown in FIG. 22, quiver 190 may be affixed to an archery bow 170 by positioning base element 50 within latch element 10. In addition, as described above, locking element 100 may be configured to rotate and lock the base element 50 within the latch element 10. Thus, assembly 90 may include an archery bow 170 and quiver 190. It should be understood that base element 50 and latch element 10 may be configured in any of the above-discussed embodiments relating to an assembly of at least one latch element and at least one base element, without limitation. In addition, the present invention contemplates that any component of an archery system may include at least one of a latch element or a base element (or combinations thereof) for mechanically coupling the component to and from an archery system. For example, referring to FIG. 22, a sight mechanism 200 may be coupled to the archery bow 170 by employing at least one base element and at least one associated latch element. Also, a stabilizer 210 may be coupled to the archery bow 170 by employing at least one base element and at least one associated latch element. Archery bow 170 may include at least one base element, at least one latch element, or combinations thereof for coupling to another system such as an all terrain vehicle or a carrying apparatus.

Accordingly, the present invention contemplates a plethora of varied applications for which various embodiments of at least one base element and at least one latch element may be utilized. Of course, at least one latch element and at least one base element may be suitably sized, structured, and formed from a selected material for resisting anticipated forces during use. Such a configuration may provide a relatively stable and robust mechanical coupling between two components of a system (e.g., an archery system). In addition, the present invention contemplates that an archery bow may include at least one latch element, at least one base element, or combinations thereof, without limitation. Further, a component (e.g., a quiver, sighting mechanism, stabilizer, etc.) may include an associated at least one base element, an associated at least one latch element, or associated combinations thereof, without limitation. For example, in some embodiments, a plurality of latch element and a plurality of base elements may provide additional stability or strength in coupling of the base elements to the latch elements. In other embodiments, a plurality of latch elements (or base elements) affixed to a system or component may provide a plurality of locations to which a base element (or latch element) may be coupled. Such a configuration may provide relative flexibility and ease of use of an assembly according to the present invention.

While certain embodiments and details have been included herein and in the attached invention disclosure for purposes of illustrating the invention, it will be apparent to those skilled in the art that various changes in the methods and apparatus disclosed herein may be made without departing form the scope of the invention, which is defined in the appended claims.

What is claimed is:

1. An archery system comprising:

an archery bow;

a latch element affixed to the archery bow, the latch element including a body and at least two retaining walls that protrude outward from the body, wherein each of the at least two retaining walls includes a surface that extends outward from the body toward each other;

a base element affixed to a component for selectively coupling to the archery system, the base element including a wide end, a narrow end, a surface configured to contact the body, and at least two side surfaces each of which is configured to contact one of the surfaces of the at least two retaining walls, wherein the two side surfaces are nonperpendicular to the surface configured to contact the body;

wherein the base element is structured to be coupled to the latch element;

a movable locking element positioned rearward of the wide end of the base element and configured to be selectively positioned at a first position configured for coupling the base element to the latch element and at least a second position configured for decoupling the base element and the latch element.

2. The archery system of claim 1, wherein the component comprises at least one of the following: a quiver, a sighting mechanism, and a stabilizer.

3. The assembly of claim 1, wherein the movable locking element is configured to rotate between the first position and the second position.

4. The assembly of claim 3, wherein the movable locking element is biased toward the first position by a biasing element.

5. The assembly of claim 4, wherein the movable locking element is configured to contact the base element when positioned at the first position.

6. The assembly of claim 5, wherein the biasing element is configured to apply a force to the base element when positioned at the first position.

7. The assembly of claim 4, further comprising a release element configured for selectively positioning the locking element in the second position.

8. The assembly of claim 1, wherein the movable locking element is biased toward the first position.

9. The assembly of claim 8, wherein the movable locking element is configured to contact the base element when positioned at the first position.

10. The assembly of claim 9, wherein the biasing element is configured to apply a force to the base element when positioned at the first position.

11. The assembly of claim 1, wherein the base element includes a periphery that is substantially quadrilateral.

12. The assembly of claim 1, wherein the base element includes a periphery that is substantially triangular.

13. The assembly of claim 12, wherein the at least two tapered side surfaces of the base element comprise two tapered side surfaces.

14. The assembly of claim 13, wherein the at least two retaining walls of the latch element comprise two retaining walls.

15. The assembly of claim 14, wherein the two retaining walls of the latch element and the two side surfaces of the base element are substantially congruent.

16. The assembly of claim 13, wherein the two side surfaces of the base element are substantially symmetric about an axis of symmetry.

17. An assembly comprising:

an archery bow;

a latch element for mounting to the archery bow, the latch element including a body and at least two retaining walls that protrude outward from the body without being joined together at any point above the body and extend lengthwise in a nonparallel direction, wherein each of the at least two nonparallel retaining walls comprises a surface that extends outward from the body toward each other;

a base element including a surface configured to contact the body and at least two side surfaces each of which is configured to contact one of the surfaces of the at least two retaining walls, wherein the two side surfaces are nonperpendicular to the surface configured to contact the body;

wherein the base element is structured to be coupled to the latch element;

a movable locking element configured to be selectively positioned at a first position in contact with a rear surface of the base member to couple the base element to the latch element and at least a second position out of contact with the rear surface of base element to permit decoupling of the base element and the latch element.

18. The assembly of claim 17, wherein the movable locking element is configured to rotate between the first position and the second position.

19. The assembly of claim 18, wherein the movable locking element is biased toward the first position by a biasing element.

20. The assembly of claim 19, wherein the movable locking element is configured to contact the base element when positioned at the first position.

21. The assembly of claim 20, wherein the biasing element is configured to apply a force to the base element when positioned at the first position.

22. The assembly of claim 19, further comprising a release element configured for selectively positioning the locking element in the second position.

23. The assembly of claim 17, wherein the movable locking element is biased toward the first position.

24. The assembly of claim 23, wherein the movable locking element is configured to contact the base element when positioned at the first position.

25. The assembly of claim 24, wherein the biasing element is configured to apply a force to the base element when positioned at the first position.

26. The assembly of claim 17, wherein the base element includes a periphery that is substantially triangular.

27. The assembly of claim 17, wherein the base element includes a periphery that is substantially quadrilateral.

28. The assembly of claim 27, wherein the at least two side surfaces of the base element comprise two side surfaces.

29. The assembly of claim 28, wherein the at least two retaining walls of the latch element comprise two retaining walls.

30. The assembly of claim 29, wherein the two retaining walls of the latch element and the two side surfaces of the base element are substantially congruent.

31. The assembly of claim 28, wherein the two side surfaces of the base element are substantially symmetric about an axis of symmetry.

32. A method of coupling a base element to a latch element, the method comprising:

providing an archery bow;

providing a latch element for attaching to the archery bow, the latch element having a body and at least two retaining walls that protrude outward from the body without being joined together at any point above the body and extend lengthwise in a nonparallel direction, wherein each of the at least two nonparallel retaining walls includes a surface that extends outward from the body toward each other;

providing a base element including a surface configured to contact the body and at least two side surfaces each of which is configured to contact one of the surfaces of the at least two retaining walls, wherein the two side surfaces are nonperpendicular to the surface configured to contact the body, wherein the base element includes a wide end and a narrow end;

positioning the base element so that the surface that is configured to contact the body is in contact with the body and the at least two side surfaces of the base element are in contact with the at least two retaining walls of the latch element, respectively;

providing a locking element positioned rearward of the wide end of the base element.

33. The method of claim 32, further comprising biasing the at least two side surfaces of the base element toward the at least two retaining walls of the latch element.

34. The method of claim 32, further comprising applying a force to the base element to cause contact between the at least two side surfaces of the base element and the at least two retaining walls of the latch element, respectively.

35. The method of claim 32, farther comprising positioning the locking element adjacent to the base element so that the base element is coupled to the latch element.

36. The method of claim 35, wherein positioning the locking element adjacent to the base element comprises rotating the locking element.

37. An assembly comprising:

an archery bow;

a latch element for attaching to the archery bow, the latch element including a body and at least two retaining walls that protrude outward from the body and extend lengthwise in a nonparallel direction, wherein at least one retaining wall includes a surface that extends outward from the body at an oblique angle;

a base element including a wide end, a narrow end, a surface configured to contact the body, and at least one side surface configured to contact the surface of the at least one retaining wall, wherein the at least one side surface is nonperpendicular to the surface configured to contact the body;

wherein the base element is structured to be coupled to the latch element;

a movable locking element positioned rearward of the wide end of the base element and configured to be selectively positioned at a first position configured for coupling the base element and the latch element and at least a second position configured for decoupling the base element and the latch element.

38. The assembly of claim 37, wherein the movable locking element is configured to rotate between the first position and the second position.

39. The assembly of claim 38, wherein the movable locking element is biased toward the first position by a biasing element.

40. The assembly of claim 39, wherein the movable locking element is configured to contact the base element when positioned at the first position.

41. The assembly of claim 40, wherein the biasing element is configured to apply a force to the base element when positioned at the first position.

42. The assembly of claim 39, further comprising a release element configured for selectively positioning the locking element in the second position.

43. The assembly of claim 37, wherein the movable locking element is biased toward the first position.

44. The assembly of claim 43, wherein the movable locking element is configured to contact the base element when positioned at the first position.

45. The assembly of claim 44, wherein the biasing element is configured to apply a force to the base element when positioned at the first position.

46. An archery system comprising:

an archery bow; a latch element affixed to the archery bow, the latch element including a body and at least two retaining walls that protrude outward from the body and extend lengthwise in a nonparallel direction, wherein each of the at least two retaining walls includes a surface that extends outward from the body toward each other;

a base element affixed to a component for selectively coupling to the archery system, the base element including a surface configured to contact the body and at least two side surfaces each of which is configured to contact one of the surfaces of the at least two retaining walls, wherein the two side surfaces are nonperpendicular to the surface configured to contact the body;

wherein the base element is structured to be coupled to the latch element;

a movable locking element configured to be selectively positioned at a first position configured for coupling the base element to the latch element and at least a second position configured for decoupling the base element and the latch element;

wherein the movable locking element comprises a surface with a radius of varying magnitude, the movable locking element further comprising a bias member which causes the locking element to rotate between the first and the second position.

47. An archery system comprising:

an archery bow;

a latch element affixed to the archery bow, the latch element including a body and at least two retaining walls that protrude outward from the body, wherein each of the at least two retaining walls includes a surface that extends outward from the body toward each other;

a base element affixed to a component for selectively coupling to the archery system, the base element including a wide end, a narrow end, a surface configured to contact the body, and at least two side surfaces each of which is configured to contact one of the surfaces of the at least two retaining walls, wherein the two side surfaces are nonperpendicular to the surface configured to contact the body, wherein the base element is structured to be coupled to the latch element, and wherein the base element includes a periphery that is substantially triangular;

a movable locking element positioned adjacent to the wide end of the base element and configured to be selectively positioned at a first position configured for coupling the base element to the latch element and at least a second position configured for decoupling the base element and the latch element.

48. An assembly comprising:

an archery bow;

a latch element for mounting to the archery bow, the latch element including a body and at least two retaining walls that protrude outward from the body without being joined together at any point above the body and extend lengthwise in a nonparallel direction, wherein each of the at least two nonparallel retaining walls comprises a surface that extends outward from the body toward each other;

a base element including a surface configured to contact the body and at least two side surfaces each of which is configured to contact one of the surfaces of the at least two retaining walls, wherein the two side surfaces are nonperpendicular to the surface configured to contact the body, wherein the base element is structured to be coupled to the latch element, and wherein the base element includes a periphery that is substantially triangular;

a movable locking element configured to be selectively positioned at a first position configured for coupling the base element to the latch element and at least a second position configured for decoupling the base element and the latch element.

49. A method of coupling a base element to a latch element, the method comprising:

providing an archery bow;

providing a latch element for attaching to the archery bow, the latch element having a body and at least two retaining walls that protrude outward from the body without being joined together at any point above the body and extend lengthwise in a nonparallel direction, wherein each of the at least two nonparallel retaining walls includes a surface that extends outward from the body toward each other;

providing a base element including a surface configured to contact the body and at least two side surfaces each of which is configured to contact one of the surfaces of the at least two retaining walls, wherein the two side surfaces are nonperpendicular to the surface configured to contact the body;

positioning the base element so that the surface that is configured to contact the body is in contact with the body and the at least two side surfaces of the base element are in contact with the at least two retaining walls of the latch element, respectively;

biasing the at least two side surfaces of the base element toward the at least two retaining walls of the latch element.

* * * * *